United States Patent [19]

Kutta et al.

[11] 4,415,337

[45] Nov. 15, 1983

[54] METHOD FOR PRODUCING AGGLOMERATE PARTICLES FROM AN AQUEOUS FEED SLURRY COMPRISING FINELY DIVIDED COAL AND FINELY DIVIDED INORGANIC SOLIDS

[75] Inventors: Helmuth W. Kutta; Donald K. Wunderlich, both of Richardson, Tex.

[73] Assignee: Atlantic Richfield Company, Los Angeles, Calif.

[21] Appl. No.: 374,838

[22] Filed: May 5, 1982

[51] Int. Cl.[3] ..... C10L 9/10

[52] U.S. Cl. ..... 44/24; 44/1 SR; 44/6; 44/25

[58] Field of Search ..... 44/1 SR, 6, 24, 25

[56] References Cited

U.S. PATENT DOCUMENTS

| | | | |
|---|---|---|---|
| 2,854,347 | 9/1958 | Booth et al. | 44/6 X |
| 3,231,346 | 1/1966 | Wilder | 44/6 X |
| 3,836,343 | 9/1974 | Romey et al. | 44/25 |
| 4,272,250 | 6/1981 | Burk, Jr. et al. | 44/15 R |

*Primary Examiner*—Carl F. Dees

*Attorney, Agent, or Firm*—F. Lindsey Scott

[57] ABSTRACT

An improved method for producing coal agglomerates from an aqueous feed slurry containing finely divided coal and finely divided inorganic solids, the method consisting essentially of mixing a quantity of oil equal to from about 25 to about 75 percent of the oil required to produce the coal agglomerates with the aqueous slurry; thereafter mixing a quantity of an aqueous solution of a suitable polymeric material in an amount sufficient to agglomerate the finely divided coal with the aqueous slurry; and recovering the coal agglomerates.

8 Claims, No Drawings

METHOD FOR PRODUCING AGGLOMERATE PARTICLES FROM AN AQUEOUS FEED SLURRY COMPRISING FINELY DIVIDED COAL AND FINELY DIVIDED INORGANIC SOLIDS

This invention relates to methods for agglomerating finely divided coal from an aqueous slurry containing finely divided coal by mixing oil with the aqueous slurry to produce coal agglomerates.

This invention further relates to a method for reducing the ash content of coal by finely dividing the coal, dispersing the finely divided coal in water and thereafter mixing oil with the resulting aqueous slurry of coal and water to produce coal agglomerates having a reduced ash content.

This invention further relates to an improvement in such methods of agglomerating finely divided coal in an aqueous slurry by the use of oil whereby the amount of oil required is reduced and an aqueous solution of polymeric material is used.

In recent years, in view of the well known energy shortage, a continuing effort has been directed to the use of fuels such as coal as a substitute for petroleum-derived fuels. In most such applications the coal is desirably of a low sulfur and ash content. Considerable effort has been directed to the development of methods for reducing sulfur emissions upon combustion of coal and considerable attention has been directed to the development and use of coal deposits which have a low ash content. The ash content of coals, in addition to producing a waste product which must be removed from the combustion zone or the reaction zone, constitutes a non-energy producing portion of the fuel which is expensive to transport and results in a lower quality fuel. Further, the ash frequently contains sulfur in the form of pyrites and the like which may be released upon combustion of the coal. Accordingly, a substantial amount of effort has been directed to the development of methods for reducing the ash content of coal. One approach considered has been a method which comprises finely dividing the coal, dispersing the finely divided coal in water, and thereafter mixing oil with the aqueous slurry of finely divided coal to produce coal agglomerates which are thereafter recovered. The coal agglomerates may be recovered by treatment to effect the attachment or inclusion of air bubbles to cause the coal agglomerates to float, as shown in U.S. Pat. No. 4,272,250, by settling followed by screening or by screening the aqueous slurry containing the coal agglomerates, as shown in U.S. Pat. No. 4,248,697 and the like. A major portion of the finely divided inorganic materials initially present in the coal is not agglomerated and is discarded with the aqueous stream in either event. Some such processes and some related processes are disclosed in:

| | |
|---|---|
| U.S. Pat. No. 4,224,038 | Masologites et al. |
| U.S. Pat. No. 4,248,697 | Halvorsen |
| U.S. Pat. No. 4,249,910 | Masologites et al. |
| U.S. Pat. No. 4,255,155 | Frankovich |
| U.S. Pat. No. 4,255,156 | Sun et al. |
| U.S. Pat. No. 4,261,699 | Sun et al. |
| U.S. Pat. No. 4,270,926 | Burk et al. |
| U.S. Pat. No. 4,270,927 | Burk et al. |
| U.S. Pat. No. 4,272,250 | Burk et al. |
| U.S. Pat. No. 4,277,252 | Dudt |
| U.S. Pat. No. 4,282,004 | Masologites |

-continued

| | |
|---|---|
| U.S. Pat. No. 4,295,858 | Sun et al. |

These patents are hereby incorporated in their entirety by reference.

One problem associated with the use of such processes is that the oil used is a relatively expensive material and is used in substantial quantities. For instance, oil may be used in quantities up to as much as about 30 weight percent based upon the coal initially charged to the process, although substantially lower quantities are frequently used. The amount of oil used is determined to a large extent by the surface area of the finely divided coal and the amount of coal present in the aqueous slurry, i.e., if the coal material which has been finely divided and dispersed in the aqueous slurry was initially 50 weight percent inorganic solids, it is clear that a lesser amount of oil would be required than were the coal substantially free of ash. Accordingly, a continuing effort has been directed to the investigation of methods for minimizing or eliminating the requirement for oil in such processes.

It has now been found that the amount of oil required in such processes can be minimized by the use of a method which consists essentially of (a) admixing a quantity of oil equal to from about 25 to about 75% of the oil required to produce the coal agglomerates with the slurry;

(b) thereafter mixing a quantity of an aqueous solution of a polymeric material selected from the group consisting of vinyl acetate, polyvinyl chloride, vinyl acetate/acrylic polymers, styrene butadiene, acrylic latex or resins, natural gums and resins, tall oil, neoprene and rubber in an amount sufficient to agglomerate the coal with the slurry and thereafter recovering the coal agglomerates.

In the practice of the method of the present invention the amount of oil required is substantially reduced. It is not fully understood why the use of the aqueous solution of polymeric material functions in the same way as the oil after the use of small quantities of oil initially, but it has been found that suitable agglomeration is so accomplished.

In tests it has been determined that the use of the polymeric material as a complete substitute for the oil is ineffective, but that when small amounts of oil are used initially in the mixing zone with the aqueous solution of a polymeric material thereafter being added desirable results are obtained.

The mixing conditions used in the contact zone are those commonly used in the art in such processes as set forth, for instance, in U.S. Pat. Nos. 4,272,250 and 4,277,252. While the polymeric materials listed are considered suitable, vinyl acetate/acrylic copolymer is considered to be particularly desirable.

The coal agglomerates produced by the practice of the present invention are of a size larger than the finely divided coal and inorganic solids charged to the process and are readily recovered from the equeous slurry after mixing with the oil and the aqueous solution of polymeric material by flotation, screening or the like, as shown in U.S. Pat. Nos. 4,272,250 and 4,248,697. The recovery of such coal agglomerates is well known and has been discussed in various of the references noted above.

While the process has been described with reference to de-ashing coal, it should be noted that a variety of process streams in the coal industry and related industries can be treated by the improved process of the present invention. For instance, in many coal cleaning operations aqueous streams containing finely divided coal, clay and inorganic solids are pumped to black water holding ponds and constitute a valuable resource which is presently not recovered. It is contemplated that such streams could be treated by the process of the present invention. Similarly, other aqueous streams containing finely divided carbonaceous solids either alone or in mixture with finely divided inorganic solids could be similarly treated.

The amount of oil normally used in the treatment of such aqueous slurries containing finely divided coal is from about 3 to about 20 weight percent based upon the weight of the coal charged to the process. By the improvement of the present invention the amount of oil required is reduced to from about 25 to about 75 percent of that required previously. The amount of aqueous solution of polymeric material added is an amount sufficient to result in suitable agglomeration of the coal. It is believed that such amounts of polymer will typically be from about 2.5 to about 7.5 weight percent based on the weight of the coal in the slurry. The polymer may be added in the form of a concentrated or dilute aqueous solution, although it is believed that in most instances more concentrated aqueous solutions will be preferred. It is to be understood that aqueous "solution" as used herein refers to dispersions of polymeric materials and emulsions of polymeric materials. The primary requisite in the polymeric material is its ability to satisfactorily agglomerate the coal. Desirably the polymeric material contains no halogens. As is well known to those skilled in the art the presence of halogens in coal is extremely detrimental to boiler operation and the like. Further the industry has relatively stringent specifications on the amount of halogens tolerable in coal fuels. Accordingly, it is undesirable that the polymeric material chosen contain halogen materials. The determination of a suitable quantity of polymeric material is well within the skill of those in the art based upon an analysis of the finely divided solids recovered with the aqueous stream and the like. In other words, if a desired quantity of the coal has not been satisfactorily recovered from the aqueous slurry then it may be desirable to use increased quantities of oil or polymer or both. Since coals from different deposits may have widely differing chemical and physical characteristics with respect to such processes it will be necessary to determine the appropriate mixture of materials and the like for optimum operation with each coal treated. Such determinations are within the skill of those in the art and need not be discussed in great detail.

Having discussed the invention by reference to certain of its preferred embodiments, it is noted that the embodiments discussed are illustrative rather than limiting in nature and that many variations and modifications are possible within the scope of the present invention. Many such variations and modifications may appear obvious and desirable to those skilled in the art based on the foregoing description of preferred embodiments and the following example.

EXAMPLE

A series of tests were run to determine the effectiveness of the ash removal from coal which was processed by treating the coal by grinding the coal, thereafter mixing it with water to produce an aqueous slurry and thereafter mixing the aqueous slurry with oil and/or a latex material in the amounts shown in Table 1. The mixing was vigorous mixing at room temperature for a time of about 15 minutes. In all tests the mixing time and temperature were substantially the same. The tests were conducted to determine the amount of coal which was recovered as coal agglomerates as well as the amount of ash removal accomplished. It will be noted that in the test conducted using 3 grams of oil 37.2 weight percent of the ash was removed with an 83.7 weight percent recovery of the coal. The lower amounts of oil did not result in satisfactory recoveries of the coal, accordingly, the ash removal for these tests was not determined. In the remaining tests, a latex material (Polyco 2151, trademark of Borden Chemical Company for vinyl acetate/acrylic copolymer—54 to 56 weight percent solids) was used. The amounts of latex material added in each test are weights of the 54–56 weight percent solution. The latex material was added (with mixing) in the quantities shown after addition (with mixing) of the quantities of oil shown. It will be noted that when only the latex material was used a poor recovery of the coal was achieved. The ash reduction was significant but the recovery of only 29 weight percent of the coal is an unsatisfactory result. By contrast, when minor quantities of oil, i.e. 1.0 gram, 1.5 grams and 2.0 grams were used with the quantities of latex material shown being added after the addition of the oil in each test, improved recoveries of the coal were realized with satisfactory ash removal. Accordingly, it is clear that a major amount of the oil normally used in the agglomeration of the coal can be replaced by the latex material when the oil is mixed with the aqueous slurry first. The latex material is considerably cheaper than the oil and represents a substantial savings in product cost by comparison to the use of larger quantities of oil. The coal tested was an Illinois No. 6 coal which initially contained 10.32 weight percent ash.

TABLE 1

| Coal | Recovered Agglomerates | | Ash Removal | Oil | Latex |
|---|---|---|---|---|---|
| (g) | (g) | (Wt. %) | Wt. % | (g) | (g) |
| 40 | 33.50 | 83.74 | 37.2 | 3.0 | — |
| 40 | 29.98 | 74.95 | — | 2.0 | — |
| 40 | 24.80 | 62.00 | — | 1.0 | — |
| 40 | 11.70 | 29.25 | 35.96 | — | 3.0 |
| 40 | 30.82 | 77.04 | 38.57 | 1.0 | 2.0 |
| 40 | 33.44 | 83.60 | 35.08 | 1.5 | 1.5 |
| 40 | 33.75 | 84.31 | 37.31 | 2.0 | 1.0 |

The results shown in Table 1 demonstrate that comparable recoveries of the coal with similar reductions in the ash content can be accomplished by the use of a latex solution of a polymeric material as a substitute for the oil in the agglomeration of the finely divided coal. As indicated previously, while the tests have been directed specifically to reducing the ash content, it is believed that the method of the present invention can similarly be applied to the recovery of finely divided coal from black water streams and the like.

Having thus described the invention, we claim:

1. A method for producing coal agglomerates from an aqueous feed slurry containing from about 10 to about 40 weight percent solids, said solids comprising finely divided coal and finely divided inorganic solids, said method consisting essentially of (a) admixing a quantity of oil equal to from about 25 to about 75 percent of the oil required to produce said coal agglomerates with said slurry;

(b) thereafter mixing an aqueous solution of a polymeric material selected from the group consisting of vinyl acetate, polyvinyl chloride, vinyl acetate/acrylic polymers, styrene-butadiene, acrylic latex or resins, natural gums and resins, tall oil, neoprene and rubber in an amount sufficient to produce said coal agglomerates with said slurry; and, (c) recovery said coal agglomerates.

2. The method of claim 1 wherein said quantity of oil required to produce said coal agglomerates is from about 3 to about 20 weight percent based on the weight of the coal in said slurry.

3. The method of claim 1 wherein said polymeric material is vinyl acetate/acrylic copolymer.

4. The method of claim 3 wherein said copolymer is admixed with said slurry as an aqueous solution of said copolymer in an amount equal to from about 2.5 to about 7.5 weight percent based on the weight of said coal in said slurry.

5. The method of claim 1 wherein said coal agglomerates are separated from said slurry by sieving.

6. In a method for reducing the ash content of finely divided coal contained in an aqueous slurry containing from about 10 to about 40 weight percent solids, said method consisting essentially of mixing said aqueous slurry containing said finely divided coal with oil to selectively agglomerate said coal into coal agglomerates having a reduced ash content and recovering said coal agglomerates, an improvement comprising: reducing the amount of oil mixed with said finely divided coal to an amount equal to from about 25 to about 75 weight percent of the oil required for agglomeration and after the addition of said reduced amount of oil mixing an aqueous solution of a polymeric material with said coal in an amount sufficient to agglomerate said coal.

7. The improvement of claim 6 wherein said polymeric material is selected from the group consisting of vinyl acetate, polyvinyl chloride, vinyl acetate/acrylic copolymers, styrenebutadiene, acrylic latex or resins, natural gums and resins, tall oil, neoprene and rubber.

8. The improvement of claim 6 wherein said polymeric material is vinyl acetate/acrylic copolymer.

* * * * *